United States Patent [19]

Reschly et al.

[11] Patent Number: 4,905,613

[45] Date of Patent: Mar. 6, 1990

[54] FUEL FEEDER

[75] Inventors: David C. Reschly, Monroe; Timothy R. Loviska, Dexter, both of Mich.

[73] Assignee: Detroit Stoker Company, Monroe, Mich.

[21] Appl. No.: 243,081

[22] Filed: Sep. 9, 1988

[51] Int. Cl.[4] ..... F23K 3/02; F23K 3/00

[52] U.S. Cl. ..... 110/105; 110/101 C

[58] Field of Search ..... 110/186, 188, 269, 101 C, 110/101 CD, 104 R, 105, 108, 329

[56] References Cited

U.S. PATENT DOCUMENTS

| | | |
|---|---|---|
| 441,689 | 12/1890 | McAuley . |
| 717,935 | 1/1903 | Shontz . |
| 740,097 | 9/1903 | Davis . |
| 745,247 | 11/1903 | Shontz . |
| 755,662 | 3/1904 | Hill . |
| 789,796 | 5/1905 | Cooke . |
| 1,132,715 | 3/1915 | Greenstreet . |
| 1,173,995 | 2/1916 | Boardman . |
| 1,211,591 | 1/1917 | Kenney et al. . |
| 1,243,186 | 10/1917 | Kohout . |
| 1,300,272 | 4/1919 | Jackson et al. . |
| 1,437,342 | 11/1922 | Griggs et al. . |
| 1,671,331 | 5/1928 | Turner et al. . |
| 1,738,379 | 12/1929 | Lower . |
| 1,931,181 | 10/1933 | Culver . |
| 2,065,552 | 12/1936 | Beers . |
| 2,099,618 | 11/1937 | Olney . |
| 2,119,010 | 5/1938 | Hogg . |
| 2,121,313 | 6/1938 | Binney . |
| 2,177,794 | 10/1939 | Turner . |
| 2,198,710 | 4/1940 | Turner . |
| 2,357,899 | 9/1944 | Kohout . |
| 2,702,726 | 2/1955 | Frendberg . |
| 3,482,534 | 12/1969 | Whitman . |
| 4,102,278 | 7/1978 | McManama . |
| 4,278,052 | 7/1981 | Sharp . |
| 4,311,102 | 1/1982 | Kolze et al. . |
| 4,326,469 | 4/1982 | Reschly . |
| 4,434,724 | 3/1984 | Kunkel, Jr. . |
| 4,528,917 | 7/1985 | Jacobs . |
| 4,532,872 | 8/1985 | Anderson . |
| 4,602,572 | 7/1986 | Giaier et al. . |
| 4,648,329 | 3/1987 | Couarc'h et al. . |
| 4,718,360 | 1/1988 | Giaier et al. . |

*Primary Examiner*—Edward G. Favors
*Assistant Examiner*—Denise L. Ferensic
*Attorney, Agent, or Firm*—Harness, Dickey & Pierce

[57] ABSTRACT

An air swept fuel feeder for feeding particulate fuel into a furnace and having a closely coupled hopper, fuel metering device and air swept delivery plate. An alternate embodiment is disclosed in which a second fuel is delivered to the furnace by an air swept plate.

23 Claims, 2 Drawing Sheets

FUEL FEEDER

The present invention relates to devices for feeding fuel to industrial furnaces (including boilers) fired by spreader stokers, fludized bed combustion, and like technologies, and more particularly to air swept fuel feeders for feeding coal, either alone or with waste material.

Most coal feeders in use today are of the mechanical type, in that they throw the coal into the furnace. Although they work well they suffer the disadvantage that they comprise many moving parts which are exposed to the heat of the furnace and sometimes damaging tramp material, all of which can present maintenance problems. Air swept plates have been in use for years, but principally for refuse, and in arrangements in which the metering device is remotely located with the refuse fuel free falling down a chute to the air swept plate. Attempts have been made to mix coal with the refuse at the remote metering location and then letting them free fall together, however these systems have not gained acceptance. Another combination feeder that was used consisted of the above mechanical coal thrower combined with an air swept refuse feeder having remote refuse metering and a free fall chute, using variable rate air to spread the refuse across the furnace grate. Also, many years ago there were coal feeders utilizing steam or compressed air to blow coal off a shelf into a furnace, but they did not use a closely coupled metering conveyor, nor did they vary steam or air flow to spread the coal across the furnace to fully cover the grate with fuel, thus providing less than optimum performance.

It is very desirable to meter the fuel as close to the furnace charging opening as possible. Not only does it make for a simpler, more compact apparatus, but it significantly improves overall control of the furnace. It eliminates the time delay between the control signal and action. Also, the longer the free fall of fuel, the higher the velocity of the fuel when it hits the air swept plate and the less control possible over its distribution.

One of the primary objects of the present invention therefore resides in the provision of an air swept coal feeder with close coupling between the metering device and air swept plate in order to provide a high degree of control and a very compact arrangement. A related object concerns the provision of an air swept refuse feeder in combination therewith. The present invention therefore obviates the aforesaid problems and provides increased reliability and overall performance.

Other advantages and features will become apparent from the following specification taken in connection with the accompanying drawings.

DESCRIPTION OF THE PREFERRED EMBODIMENTS

Figure 1:
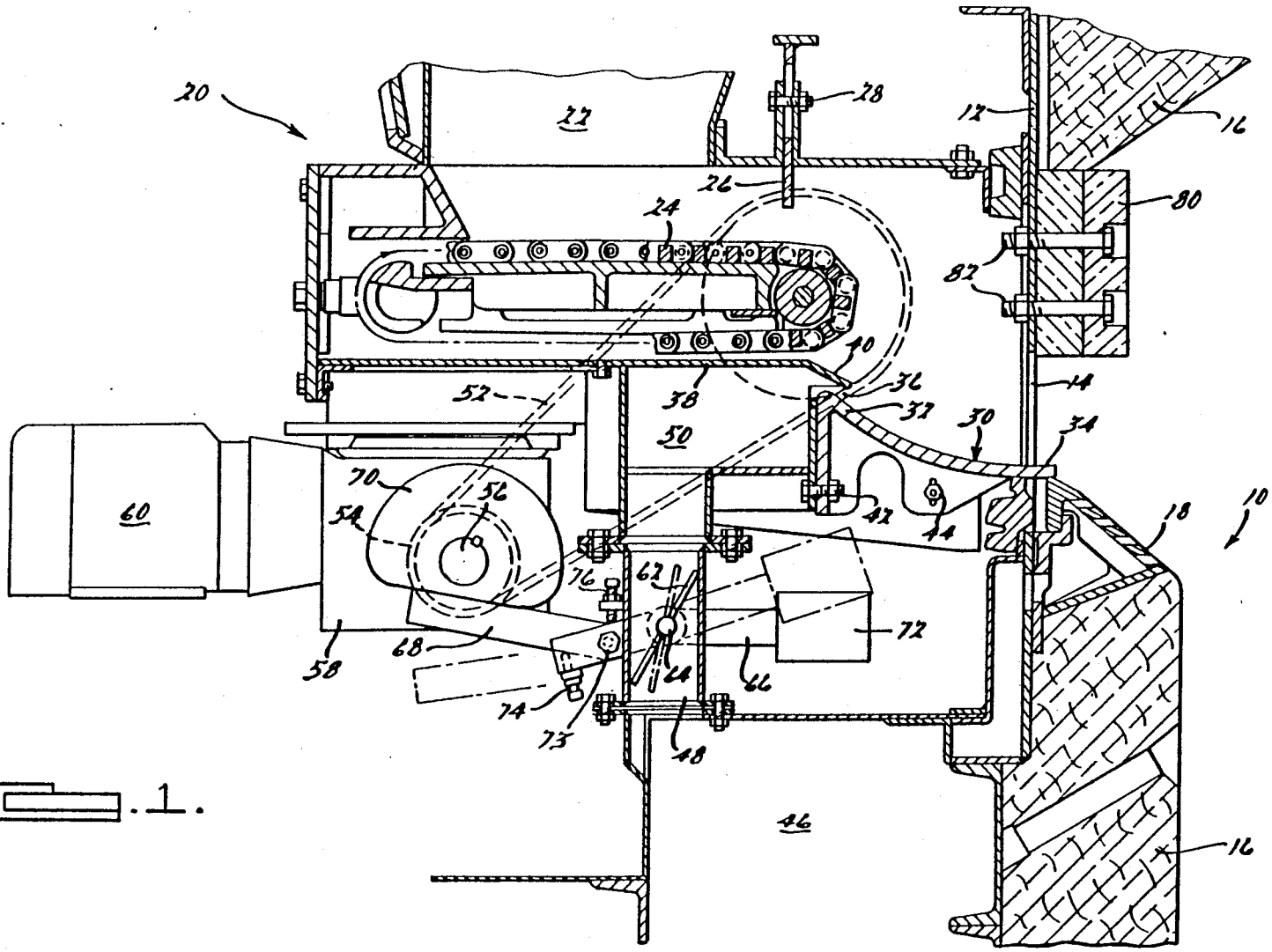
FIG. 1 is a diagrammatic vertical section view of a coal fuel feeder embodying like principles of the present invention taken from the side thereof.

Referring to FIG. 1, there is illustrated a furnace 10 having a front wall 12 in which is provided a fuel delivery or charging opening 14. The furnace is provided with the normal insulation and refractory 16, tuyeres 18, etc. and in all respects is conventional except as specifically noted.

Disposed immediately outside charging opening 14 is a feeder 20 embodying the principles of the present invention. The feeder generally comprises a normally filled coal hopper 22 disposed over and opening downwardly onto a metering device in the form of a chain conveyor 24 which is driven in a clockwise direction as shown. The depth of coal delivered by conveyor 24, which varies with the type and size coal being used, is controlled by a vertically movable adjustable gate 26 which is held in pre-set position above the top surface of conveyor 24 by means of a threaded fastener 28. Metered coal delivered by conveyor 24 drops onto an air swept plate 30 which is slightly concave in an upwardly facing direction and has an outer portion 32 disposed immediately adjacent and below the delivery end of the conveyor, and an inner portion 34 extending through charging opening 14. If desired, other types of metering devices may be used; such as, rotary driven or vibrating conveyor-type metering devices.

An air spout or nozzle 36 is disposed immediately above outer portion 32 and is defined by the upper surface of plate 30 and a deflector plate 38 having an inclined edge portion 40 defining the nozzle. Plate 30 is held in place by fasteners 42 and 44 which pass through slots in the plate so that it can be adjusted up and down to vary the size of nozzle 36. Air of adequate pressure and volume from the usual source is supplied to nozzle 36 via an air plenum 46 which communicates through a passage 48 with chamber 50, which directly supplies nozzle 36.

Conveyor 24 is powered by a roller chain 52 driven by a sprocket 54 on an output shaft 56 of a gearbox 58 driven by an electric motor 60. Motor 60 is preferably a variable speed motor, AC or DC, and is controlled in the usual manner by a signal from the combustion control systems (not shown) to vary the coal feed rate to satisfy the output requirements of the boiler or furnace.

The pressure and volume of air supplied to chamber 50, which determines the rate of air flow through nozzle 36, is continuously varied during operation of the feeder by a valve in the form of a damper 62 disposed in passage 48, both of which extend approximately one-half to two-thirds of the width of the feeder as viewed from the front. Damper 62 is mounted on an actuating shaft 64 to which is fixed a lever 66 having at one end a follower 68 engaging a cam 70 driven by output shaft 56 and at the other end a counterweight 72 to bias follower 68 toward cam 70. Follower 68 is mounted on lever 66 by means of a fastener 73 and an adjusting screw 74 is provided on lever 66 to fine adjust the angular position of follower 68 with regard to lever 66 to properly define the extreme positions of damper 62. In addition, a second adjusting screw 76 is provided to vary the degree of oscillation of lever 66 and hence damper 62. When properly adjusted, the air being delivered to nozzle 36 varies continuously between a minimum rate necessary to propel the coal on plate 30 to the near end of the furnace grate (not shown) and a maximum rate necessary to propel the coal to the far end of the grate.

Another advantage of the present feeder is that a smaller charging opening is required than for a mechanical fuel thrower, thus permitting the use of additional insulation, such as shown at 80 held by fasteners 82, to protect the mechanical parts of conveyor 24 from the radiant heat of the furnace.

Figure 2:
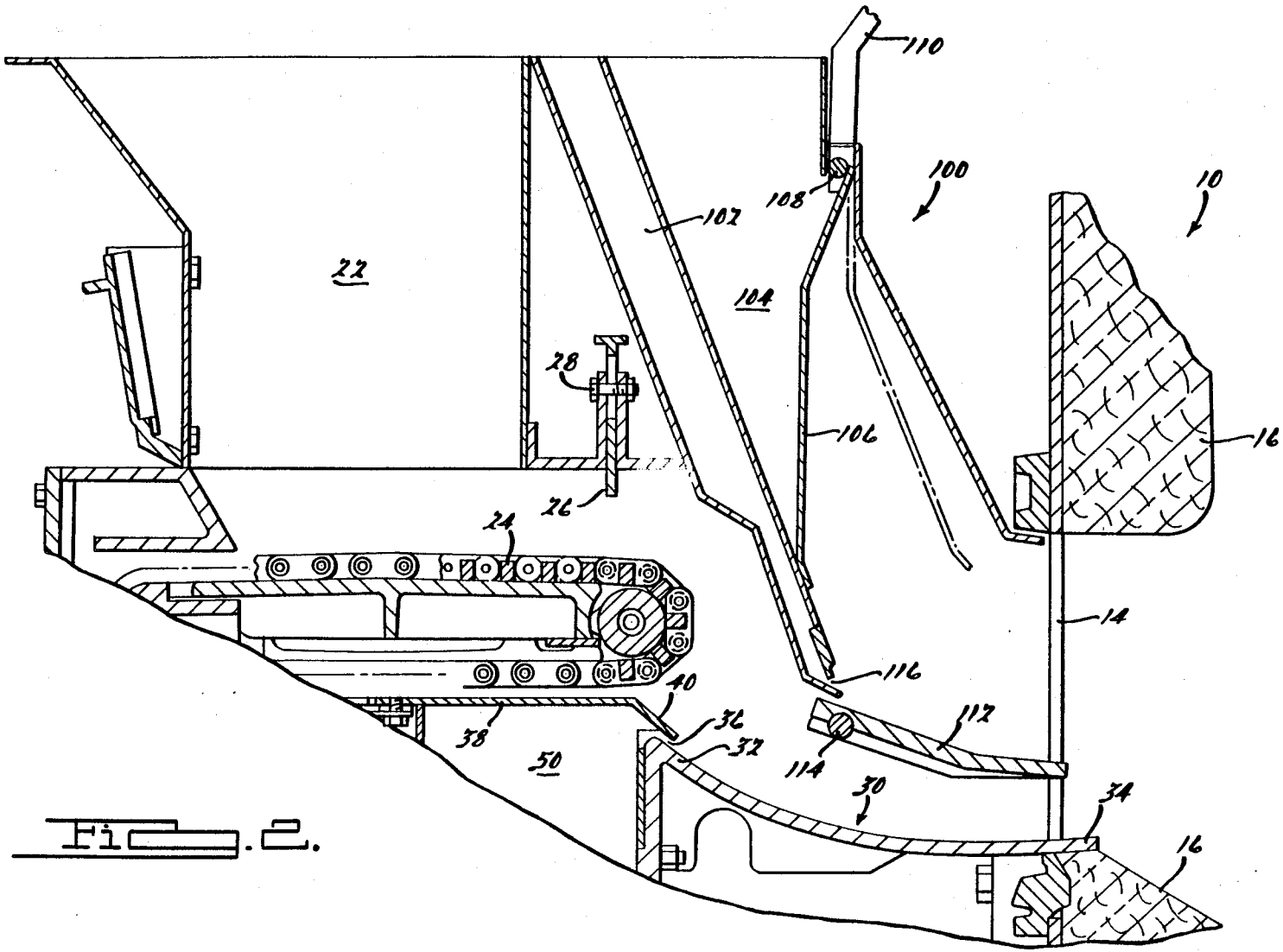
FIG. 2 is a view similar to FIG. 1 illustrating an alternative embodiment of the present invention which feeds coal and refuse.

An alternative embodiment of the present invention, which will also feed with the coal a refuse derived fuel (such as wood chips, furfural residue, bagasse, shredded industrial waste, etc. seized so as not to clog) is shown in FIG. 2 at 100. The coal feeder portion of feeder 100 is the same as that in FIG. 1, except for repositioning and relatively minor dimensional changes to accommodate the refuse feeding portion, and therefore the same reference numerals have been used for like parts.

The refuse feeder generally comprises an air box 102 and a refuse inlet chute 104 having at the discharge end thereof a damper 106 hinged on a shaft 108 to which is affixed a counterweight 110 to bias the damper to its solid line position shown. As remotely metered refuse falls down chute 104 it pushes damper 106 in a direction toward its phantom line position shown and falls on to an air swept distribution plate 112 hinged for adjustment at one end on a pivotable shaft 114 and having an opposite end extending through opening 14 into furnace 10. Remote metering of the refuse can be accomplished with any known refuse derived fuel metering device.

Air box 102, which is supplied air at a continuously varying rate by means similar to that used in the first embodiment, has at the lower end thereof a nozzle 116, which can be made adjustable in any desired manner. The air from nozzle 116 propels refuse on plate 112 into the furnace, along with and in the same manner as coal is propelled into the furnace in the first embodiment.

Separate air swept plate 112 is believed necessary because refuse fuel has such a low bulk density and heating value that large quantities must be supplied, which can create a clogging problem. Plate 112 can be adjusted to minimize this possibility and in any case would permit the continued feeding of coal in the event the refuse chute became clogged. In certain applications where clogging is not likely to occur, plate 112 could be omitted and both types of fuel could be propelled into the furnace off plate 30 using the air from nozzle 36 (in which case air box 102 and nozzle 116 would not be necessary).

While it will be apparent that the preferred embodiments of the invention disclosed are well calculated to provide the advantages and features above stated, it will be appreciated that the invention is susceptible to modification, variation and change without department from the proper scope or fair meaning of the subjoined claims.

What is claimed is:

1. A feeder for feeding particulate fuel into a furnace having a fuel charging opening, comprising:

(a) a fuel hopper designed to be maintained substantially full of fuel and having an open lower end;

(b) a metering device for conveying fuel in a direction towards said furnace, said metering device being disposed immediately below said open lower end of said hopper and arranged to receive fuel therefrom;

(c) means defining a fuel delivery opening in the side of said hopper nearest said furnace, said fuel delivery opening being disposed immediately adjacent said metering device with the top of said metering device defining the bottom of said opening;

(d) an adjustable means associated with said metering device for metering the quantity of fuel delivered by said metering device to said furnace;

(e) a generally horizontally disposed, upwardly facing, slightly concave plate having a first portion disposed generally between said furnace and conveyor and positioned to receive fuel delivered by said conveyor, and a second portion extending into said charging opening, said first portion of said plate being disposed below and immediately adjacent the end of said metering device closest to said furnace;

(f) an air spout disposed above and adjacent said first portion of said plate, said spout including a nozzle positioned to direct air along the top surface of said plate against fuel delivered to said plate by said metering device to propel same across said plate into said furnace; and (g) flow control means for supplying air at a continuously varying flow rate to said spout so that fuel is propelled into said furnace over a range of distances.

2. A feeder as claimed in claim 1 wherein said flow control means comprises a valve having an actuating shaft and being disposed in an air supply passage, and powered actuating means connected to said shaft for causing said valve to oscillate between a relatively open position and a relatively closed position when said feeder is operating.

3. A feeder as claimed in claim 2 wherein said actuating means comprises a lever arm affixed to said shaft, a powered cam engaging said arm to cause it to oscillate and a counterweight on said arm to cause said arm to be biased towards said cam.

4. A feeder as claimed in claim 3 wherein said metering device and cam are drivingly interconnected.

5. A feeder as claimed in claim 3 further comprising adjustable limit means for limiting the maximum amplitude of oscillation of said lever arm.

6. A feeder as claimed in claim 3 further comprising means for adjusting said valve relative to said passage between a relatively open position and a relatively closed position.

7. A feeder as claimed in claim 1 wherein said metering device is a generally horizontally disposed conveyor.

8. A feeder as claimed in claim 7 wherein said adjustable means is a gate which controls the depth of fuel delivered by said conveyor.

9. A feeder as claimed in claim 8 wherein said gate is disposed in said fuel delivery opening.

10. A feeder as claimed in claim 1 further comprising means for adjusting the flow opening in said nozzle.

11. A feeder as claimed in claim 1 further comprising means for adjusting said flow control means for changing the maximum and minimum values of said varying flow rate.

12. A feeder as claimed in claim 1 wherein said fuel is coal.

13. A feeder for feeding particulate fuel into a furnace having a fuel charging opening, comprising:

(a) a fuel hopper having an open lower end;

(b) a metering device for conveying fuel in a direction towards said furnace, said metering device being disposed immediately adjacent said hopper and arranged to receive fuel therefrom;

(c) means associated with said metering device for metering the quantity of fuel delivered by said metering device to said furnace;

(d) a generally horizontally disposed upwardly facing, slightly concave plate having a first portion disposed generally between said metering device and said furnace and positioned to receive fuel delivered by said metering device, and a second portion extending through said charging opening, said first portion of said plate being disposed immediately adjacent the end of said metering device closest to said furnace; and (e) an air spout disposed above and adjacent said first portion of said plate, said spout including a nozzle positioned to direct air along the top surface of said plate against fuel delivered to said plate by said metering device to propel same across said plate into said furnace.

14. A feeder as claimed in claim 13 further comprising flow control means for supplying air at a continuously varying flow rate to said spout so that fuel is propelled into said furnace over a range of distances.

15. A feeder as claimed in claim 13 further comprising means for adjusting the flow opening in said nozzle.

16. A feeder as claimed in claim 13 further comprising means for adjusting said flow control means for changing the maximum and minimum values of said varying flow rate.

17. A feeder as claimed in claim 13 wherein said metering device is a generally horizontal conveyor.

18. A feeder as claimed in claim 17 wherein said metering means controls the depth of fuel delivered by said conveyor.

19. A feeder as claimed in claim 11 wherein said fuel is coal and further comprising means for delivering refuse derived fuel to said plate, whereby said coal and refuse derived fuel are propelled into the furnace together.

20. A feeder for feeding particulate fuel into a furnace having a fuel charging opening, comprising:

(a) a first fuel hopper having an open lower end;

(b) a metering device for conveying fuel in a direction towards said furnace, said metering device being disposed immediately adjacent said hopper and arranged to receive fuel therefrom;

(c) means associated with said metering device for metering the quantity of fuel delivered by said metering device to said furnace;

(d) a generally horizontally disposed upwardly facing first plate having a first portion disposed generally between said furnace and conveyor and positioned to receive fuel delivered by said metering device, and a second portion extending through said charging opening, said first portion of said first plate being disposed immediately adjacent the end of said metering device closest to said furnace;

(e) a first air spout disposed above and adjacent said first portion of said first plate, said first spout being positioned to direct air along the top surface of said first plate against fuel delivered to said first plate by said metering device to propel same into said furnace.

(f) a second hopper for refuse derived fuel designed to have metered refuse fuel fall therethrough;

(g) means defining a second fuel delivery opening at the lower end of said second hopper adjacent said charging opening;

(h) a generally horizontally disposed upwardly facing second plate having a first portion positioned to receive fuel delivered from said second hopper, and a second portion extending through said charging opening into said furnace, said first portion of said second plate being disposed below said second discharge opening; and (i) a second air spout disposed above and adjacent said first portion of said second plate, said second spout being positioned to direct air along the top surface of said second plate against refuse derived fuel delivered to said second plate to propel same across said plate into said furnace.

21. A feeder as claimed in claim 20 further comprising second flow control means for supplying air at a continuously varying flow rate to said second spout so that refuse fuel is propelled into said furnace over a range of distances.

22. A feeder as claimed in claim 20 further comprising a pivotal damper in said second hopper operable by said refuse derived fuel.

23. A feeder as claimed in claim 20 wherein said metering device is a generally horizontal conveyor.

* * * * *

UNITED STATES PATENT AND TRADEMARK OFFICE

CERTIFICATE OF CORRECTION

PATENT NO. : 4,905,613

DATED : March 6, 1990

INVENTOR(S) : David C. Reschly and Timothy R. Loviska

It is certified that error appears in the above-identified patent and that said Letters Patent is hereby corrected as shown below:

Column 1, line 6, "fludized" should be -- fluidized --.

Column 3, line 45, "department" should be -- departing --.

Column 6, lines 11 and 12, Claim 20, after "furnace" change "." to -- ; --.

Signed and Sealed this

Sixteenth Day of July, 1991

*Attest:*

HARRY F. MANBECK, JR.

*Attesting Officer*

*Commissioner of Patents and Trademarks*